US005222832A

United States Patent [19]

Sunderhaus et al.

[11] Patent Number: 5,222,832

[45] Date of Patent: Jun. 29, 1993

[54] SPILL CONTAINMENT DEVICES AND THEIR INSTALLATION

[75] Inventors: Charles A. Sunderhaus, Hamilton; Eric J. Butterfield; James E. Kesterman, both of Cincinnati, all of Ohio; Frank G. Lamping, Bellevue, Ky.

[73] Assignee: Dover Corporation, New York, N.Y.

[21] Appl. No.: 757,456

[22] Filed: Sep. 10, 1991

[51] Int. Cl.[5] ..... B65G 5/00

[52] U.S. Cl. ..... 405/52; 141/86; 405/53

[58] Field of Search ..... 405/52, 53, 128, 129; 52/20; 137/312; 141/86

[56] References Cited

U.S. PATENT DOCUMENTS

| | | | |
|---|---|---|---|
| 4,659,251 | 4/1987 | Petter et al. | 405/52 |
| 4,762,440 | 8/1988 | Argandona | 405/52 |
| 4,842,443 | 6/1989 | Argandona | 405/52 |
| 4,896,705 | 1/1990 | Podgers et al. | 141/86 |
| 4,958,957 | 9/1990 | Berg et al. | 405/52 X |
| 4,960,346 | 10/1990 | Tamayo | 405/52 |
| 5,114,271 | 5/1992 | Sunderhaus et al. | 405/52 |
| 5,117,877 | 6/1992 | Sharp | 141/86 |

*Primary Examiner*—David H. Corbin
*Attorney, Agent, or Firm*—Kinney & Schenk

[57] ABSTRACT

A below grade, spill containment device for connection with the riser pipe of an underground fuel storage tank. The containment device is disposed within and isolated from a manhole, which is mounted in a concrete apron. The containment device comprises a compositely formed container, rigidly mounted on the riser pipe. The container formed of structural synthetic resin material elements held in assembled relation by snap fitted lugs and notches. A lid, for closing the upper, access opening, is mounted on a pivotable arm. A lever pivoted on the arm selectively engage latch means to lock the lid in a closed position. A projection on the lever prevents the manhole cover from seating if the lever is not in its lock position. A valve for draining fuel from the container to the riser pipe is closed when the lid is open and opened when the lid is closed. The manhole and the containment device are packaged in a shipping carton in spaced relation be corrugated paper sheets. These sheets are employed in obtaining a desired relation between the containment device and manhole in the installation of these components, which involve pouring a concrete apron around the upper end of the manhole. An alternative system employs adjusting nuts to obtain this relationship between the manhole and containment device. In one embodiment the manhole is compositely formed to permit relative movement between its upper and lower portions, after installation.

65 Claims, 11 Drawing Sheets

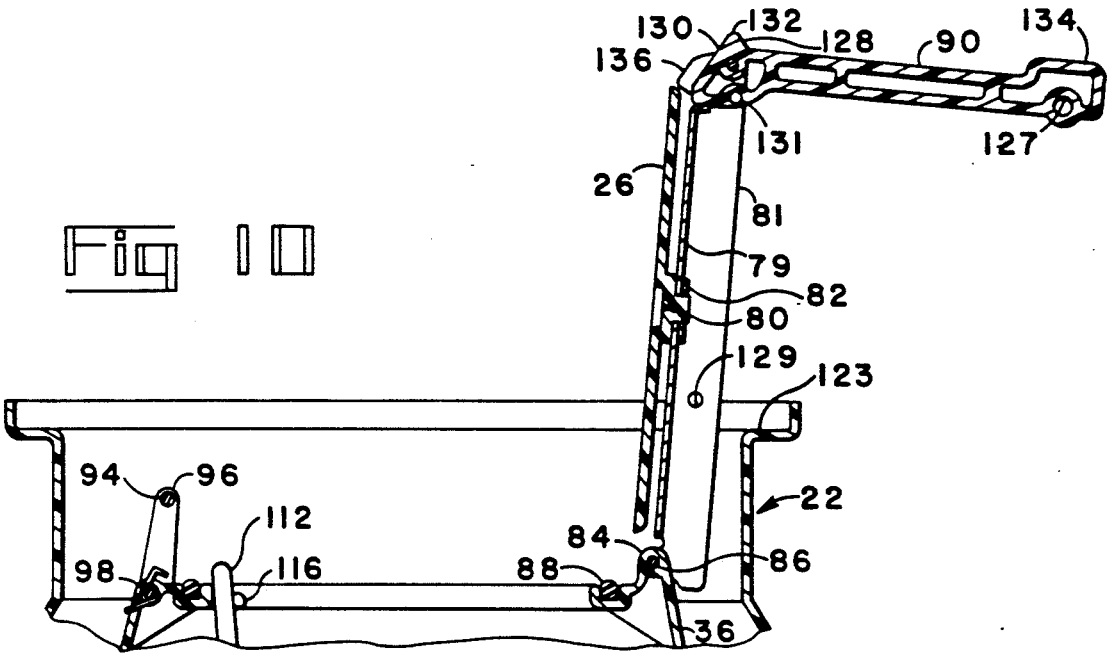
Fig 10
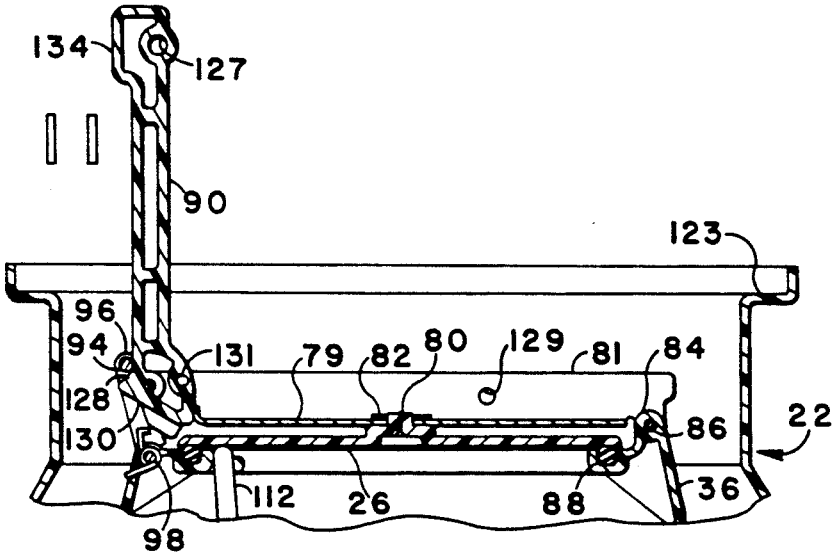
Fig 11
Fig 12
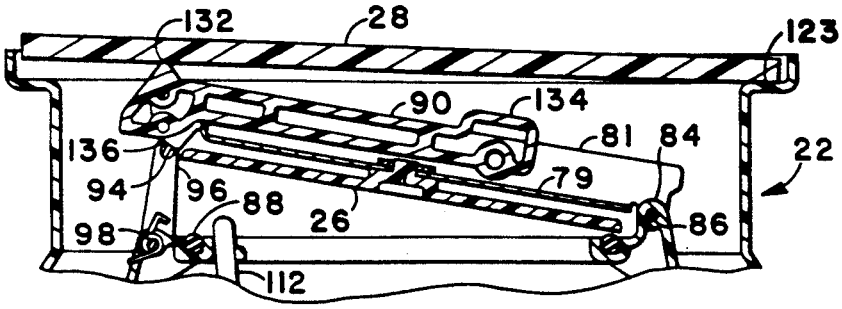

SPILL CONTAINMENT DEVICES AND THEIR INSTALLATION

The present invention relates to improvements in spill containment devices which are employed to prevent ground contamination in the filling of underground storage tanks for liquid fuels and other liquids capable of creating a hazard, if present in the soil. The invention additionally relates to improvements in the installation of spill containment devices.

While not necessarily so limited, the present invention is directed to the problem of ground contamination in the filling of underground storage tanks at retail service station for gasoline and similar petroleum base fuels. In a typical installation, the underground storage tank has a riser pipe through which fuel is discharge from a fuel tank has a riser pipe through which fuel is a concrete apron overlies the tank, with the riser pipe terminating below the level of the apron, within a manhole. The manhole has a cover which is removable to permit access to the riser pipe, for connection of a fuel hose thereto. The basic problem is that in connecting and disconnecting the hose, fuel is spilled. In the usual filling operation, the amount of spilled fuel is relatively small. Even so, the cumulative effect, over the several years, can cause significant, hazardous contamination, if the fuel is permitted to simply be absorbed into the soil. Also, significant quantities of fuel can be spilled where there is a failure to shut off the flow of fuel at the fuel tank, before the storage tank is filled. In such event, the volume of fuel in the delivery hose can be spilled, when the hose is disconnected from the riser pipe.

These problems have been recognized and many proposals are found in the prior art for controlling spilled fuel to prevent it from contaminating the underlying soil. Basically these proposals provide means for capturing the spilled fuel, and, in most case, then returning the spilled fuel to the storage tank. In simplest form, such spill containment devices provide a bottom wall for the cylindrical manhole within which the riser pipe is disposed. The bottom wall is then sealingly connected to the riser pipe to form what has been variously referenced as a sump, container, or bucket, the upper end of which is sealed by the removable manhole cover.

This approach to spill containment has an inherent problem in accommodating relative movement between the riser pipe and the manhole which is locked in a concrete apron. In northern areas, such movement is caused by frost heaves, due to the storage tank being buried at a level below the front line. In both northern and southern areas, relative movement can result from settling of the tank, or apron, after installation. While effective solutions have been found for accommodating such relative movement, they are relatively expensive, usually involving flexible members, and, over time, are subject to degradation.

An alternate approach to spill containment is found in a so called below grade installation wherein a container is mounted on the upper end of a storage tank riser pipe. The container is disposed within and structurally isolated from an open ended manhole. The container has an access opening in its upper end, which is normally closed by a lid. The manhole is anchored in the concrete apron and provided with a removable cover which is flush with the surface of the apron. The cover is removed and the lid opened to gain access to the interior of the container and the riser pipe. The fuel delivery hose is connected to and disconnected from the riser pipe, within the container so that the any spilled fuel is captured therein. With this approach there is no relative movement between the structure components of the containment device and, therefore a higher degree of reliability and a longer useful life of the containment device is obtained.

The general object of the present invention is to provide below grade, spill containment devices.

Another object of the present invention is to reduce the cost of spill containment devices, particularly devices having a relatively large capacity capable of capturing the volume of fuel in a fuel delivery hose.

A further object of the present invention to provide lid closing and locking means having improved effectiveness.

A still further object of the present invention is to provide means for alerting an attendant that the container lid is not properly locked.

Yet another object of the present invention is provide improved means for draining spilled fuel from the container to the riser pipe and then back to the storage tank.

Still another object of the present invention is to facilitate positioning of a manhole relative to a container, mounted on a riser pipe, when a concrete apron is poured in the construction of a below grade installation.

Briefly stated, the foregoing ends are broadly attained in the following fashion.

The containment device container is compositely formed by a base member, a body member and an upper member. These members, are rigidly and sealingly connected. The base member has means for rigidly connecting it to the riser pipe. The upper member defines an access opening, with a lid for that opening being pivotally mounted thereon. The base member, body member and upper member are preferably formed of a structural, synthetic resin and are connected together by snap fitted connections.

In accordance with another aspect of the invention, the lid mounting means includes an arm, pivotally mounted on the container. Means for locking the lid in a closed position comprise a lever, pivotally mounted on this arm and engageable with latch means, mounted on the container opposite the mounting for the arm.

In accordance with another aspect of the invention, means are provided for preventing a manhole cover from seating, if the container lid is not locked in a closed position. The lid is thus tilted to alert an attendant that the lid is not locked.

In accordance with another aspect of the invention, comprises a passageway leading from the interior of the container to the riser pipe. A normally closed valve controls flow of fuel through this passageway. Means are provided for automatically opening this valve, when the container lid is closed.

In accordance with other aspects of the invention, a method of installing a containment device and manhole comprises employing spacer means to position the manhole, relative to the containment device, after the latter has been mounted on a riser pipe. The spacer means are deformable to position the manhole in a vertical position and at a desired height, to accommodate angular and heightwise variations, in the position of the upper end of the riser pipe, from a desired position. The upper end of the manhole can thus be positioned flush with the desired grade lever for a concrete apron, which is then poured. Advantageously the spacer means take the form of corrugated paper sheets.

A further aspect of the invention is found is packaging a containment device and manhole in a shipping carton, with these components disposed in the approximate relative relation desired when they are installed. This relationship, in the shipping carton is provided by spacer means. After removal from the carton, the containment device is mounted on a riser pipe and the shipping spacing means are employed to position the manhole, as above described. A further aspect of the invention is found in the provision of means for obtaining a desired position of a manhole relative to a containment device effecting a below grade installation. These means may comprise a pair of bars, registered on the lid of the container, by studs. Adjusting screws, secured to the manhole, overlie the ends of the bars and pass through holes therein. Nuts, threaded onto the adjusting screws, support the manhole and provide for selective heightwise adjustment thereof.

Further aspects of the invention are found in compositely forming a manhole of an upper rim portion and a lower shell portion, which have telescoped, connecting portions. The telescoped portions are prevented from relative movement in response to relatively low forces so that the manhole may be handled as a unit during its installation. The telescoped portions are relatively movable in response to higher forces, so that, when the rim portion is locked in a concrete apron, there can be relative movement with respect to the lower, shell portion, as a result of settling, or the like.

The above and other related objects and features of the invention will be apparent from a reading of the following description of a preferred embodiment of the invention and the novelty thereof pointed out in the appended claims.

IN THE DRAWINGS

FIG. 8 is an elevation, on a further enlarged scale, of the locking means, with portions thereof broken away and in section;

FIGS. 10-12 are views, in section, illustrating articulation of the lid locking means in use;

FIG. 18 is a section, taken on line 18—18 in FIG. 17.

Figure 1:
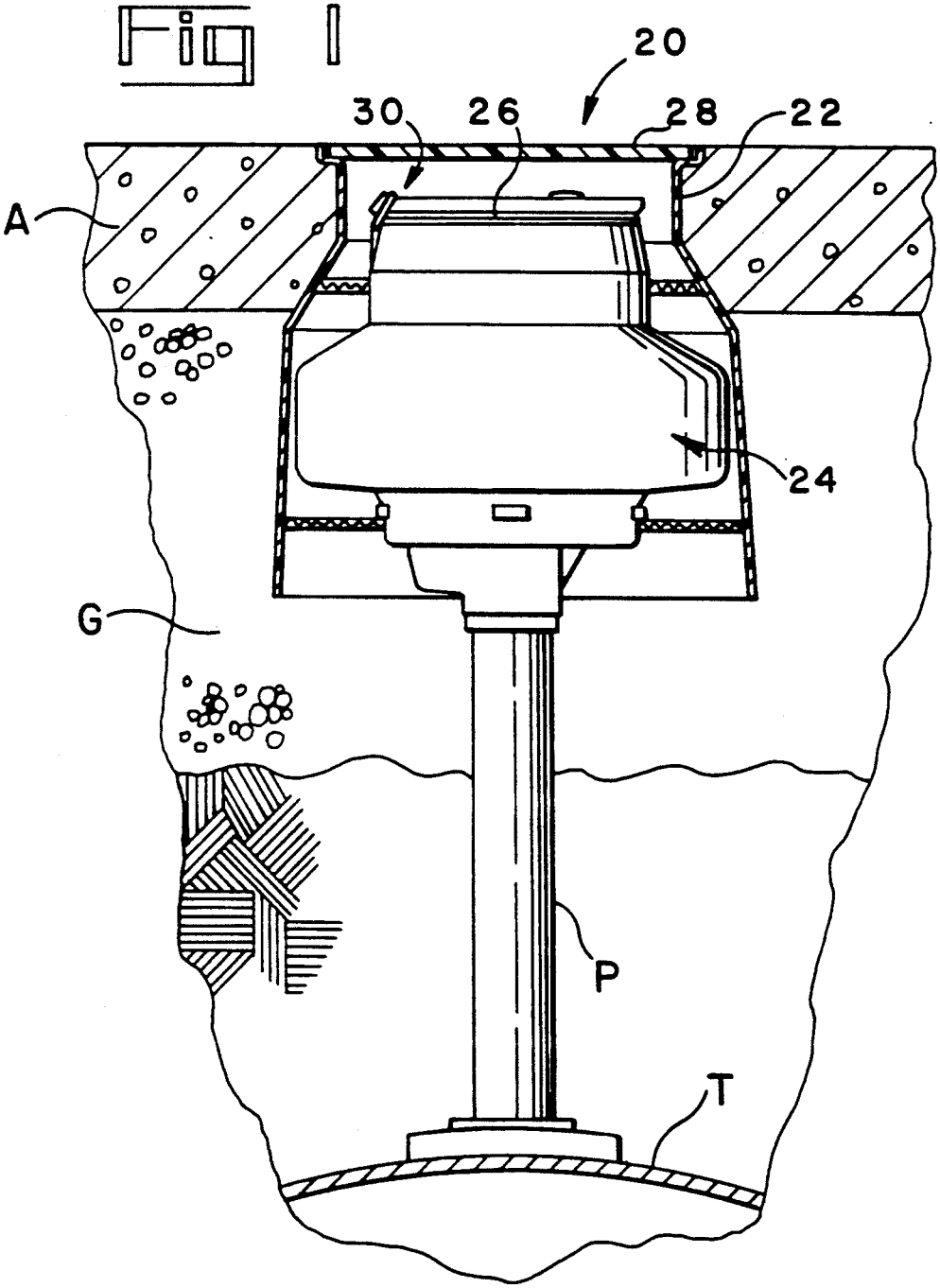
FIG. 1 is an elevation, partially in section, illustrating the installation of the present containment device on an underground storage tank.

FIG. 1 illustrates an installed fuel storage tank T having a vertical riser pipe P mounted on its upper surface. A containment device 20, embodying the present invention, is mounted on the upper end of the riser pipe P. In a typical installation, a tank is disposed in an excavation, the soil back filled, a layer G of pea gravel is then filled into the excavation. A concrete apron A is poured over the pea gravel to complete the installation.

The described containment device is of the so-called below grade type. Thus, it is disposed below the level of the apron A and within a manhole 22. The containment device comprises a container 24, sealed at its lower end to the riser pipe P, and sealed at its upper end by a lid 26. The upper end of the manhole is closed by a removable cover 28. When it is desired to load fuel into the tank T, the cover 28 is first removed. Lid locking means 30 are then released and the lid 26 swung to a position providing access to the interior of the container 24. A fuel delivery hose is connected to the riser pipe P and fuel discharged into the tank T. After the desired amount of fuel has been delivered, the hose is disconnected and the lid 26 is closed to seal off the upper end of the container 24. Finally, the cover 28 is replaced to close off the upper end of the manhole 22.

From the foregoing it will be apparent that the entrance, or access opening, to the container 24 is spaced from the upper manhole opening and sealed, after each filling of the tank T. Thus, when the cover 28 is removed, and the lid 26 opened, there is a minimum likelihood that liquids, or other foreign matter, will enter the container 24 and become a source of contamination for fuel. It will also be appreciated that a positive seal between the cover 28 and manhole 22 is not required. This is to say that any water, which may leak beneath the cover 28, simply drains around the container 24, passes through the pea gravel layer and then is absorbed into the soil. Thus, the cover 28 may be mounted flush with the surface of the apron A, eliminating the conical surface bumps found in containment device containers, which have their opening at the grade level of the apron. Among other things, the flush mounting of the manhole cover facilitates snow removal and damage which can be caused by a snow plow blade.

It is further to be recognized that relative movement is to be expected between the apron A and the tank T. Such relative movement can result from settling of the tank after installation. Also, the tank T is disposed below the frost line, so that there will be relative movement between the tank and the apron, as a function ground freezing. The containment device 20 is isolated from frozen ground, by being structurally independent of the manhole 22. Thus, it is possible to rigidly connect the containment device to the riser pipe P and obtain a positive seal therewith, which is not subject to forces which would tend to result in leakage at the connection therebetween.

Figure 2:
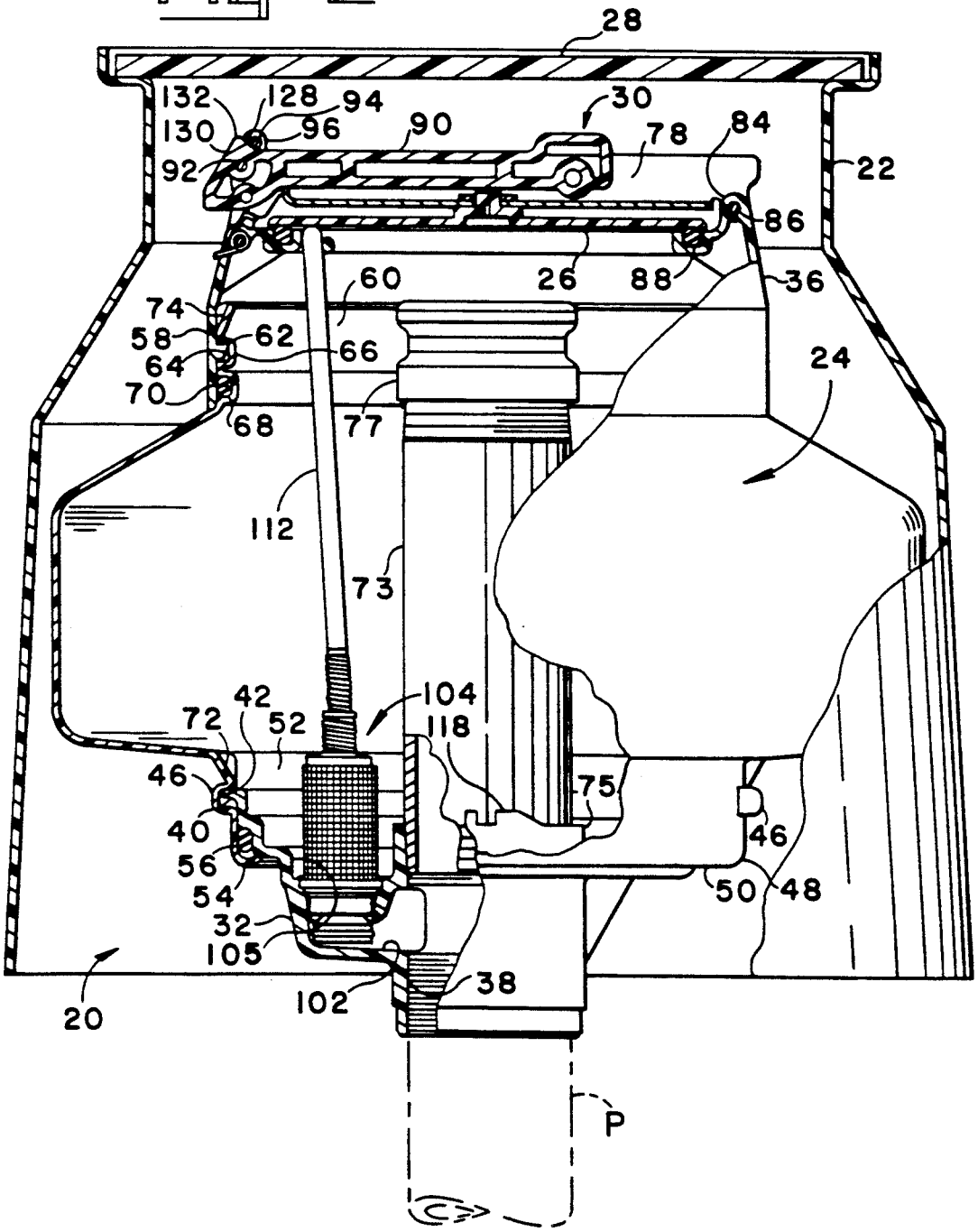
FIG. 2 is an elevation, on an enlarged scale and with further portions in section, of the containment device seen in FIG. 1.
Figure 3:
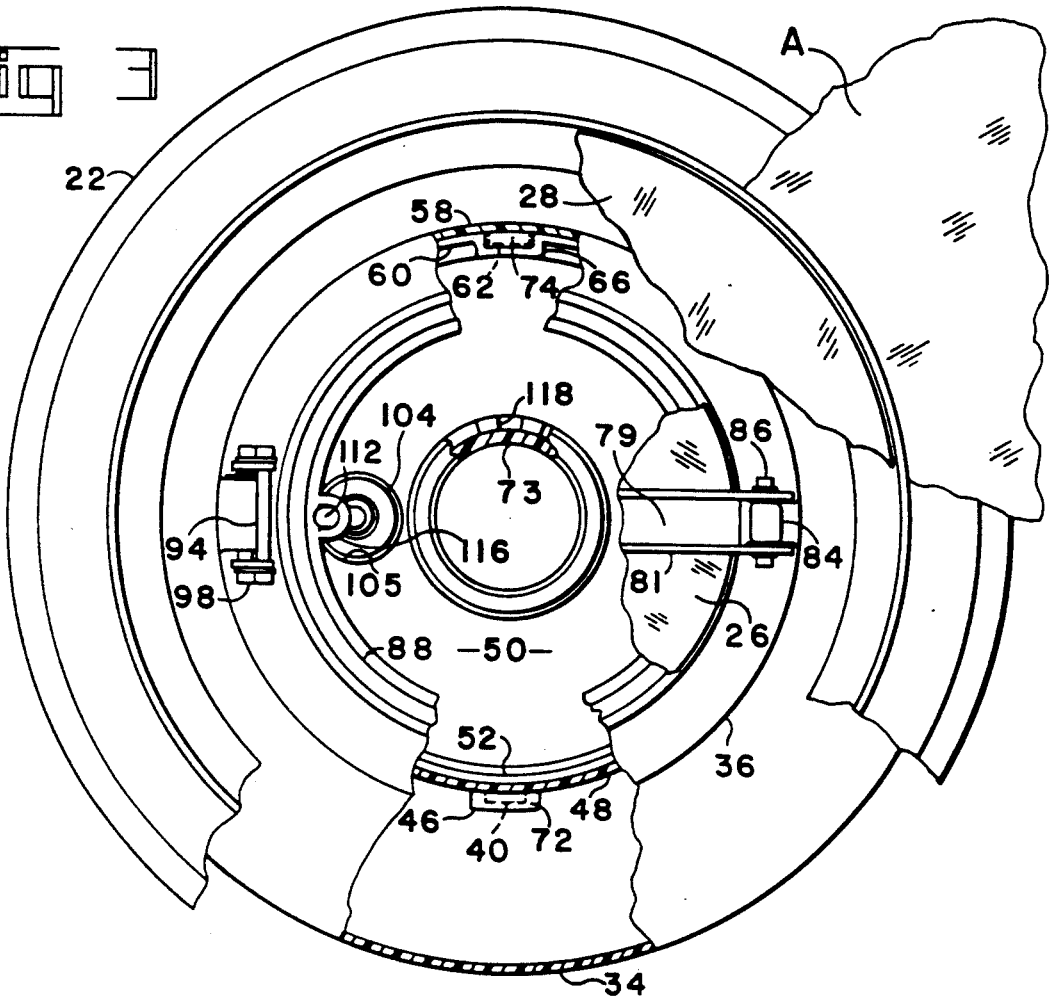
FIG. 3 is a plan view of the containment device.

Reference is next made to FIGS. 2 and 3 for a detailed description of the containment device 20.

The container 24 is, preferably, compositively formed and comprises a base 32, a body member 34 and an upper, lid seat member 36. The base 32 has a central, pipe threaded opening 38 which is engaged with the upper end of the riser pipe P, to provide a reliable sealed connection therewith. The body member 34 is joined to the base 32 by a snap connection comprising lugs 40 which engage notches 42, formed in outward protrusions 46 of a downwardly extending, cylindrical portion 48 of the body member 34. The base 32 comprises a radial flange 50 and an upstanding, cylindrical portion 52, which is telescoped within the cylindrical portion 48 of the body member 34.

The cylindrical portion 48, of the body member 34, has an inturned lip 54, which underlies the bottom forming flange 50 of the base 32. An O-ring 56 is compressed between the lower telescoped portions 48, 52 to provide a seal between the base 32 and the body member 34.

The upper container member 36 is similarly mounted, by a snap fit connection, on the upper end of the base member 34. The upper member 36 and body member 34 have telescoped cylindrical portions 58, 60. Inwardly projecting lugs 62, from the upper member 36, are engaged with notches 64, formed in inwardly projecting protrusions 66 on the body member 34.

An O-ring 68 is disposed in a groove 70, formed in the cylindrical portion 60, engages the inner surface of the cylindrical portion 58 to provide a seal between the upper member 36 and the body member 34.

Assembly of the container members 32, 34 and 36 is simply accomplished by compressing them into assembled relationship. This is to say that these members with the O-ring 68 in groove 70 and the O-ring 56 mounted on the flange 50 may be stacked in registered relation and then a downward force exerted. To facilitate this assembly, the upper, entrance portions to the notches 42 and 64 are formed by angled surfaces 72, 74 respectively. The respective sleeve portions are thereby cammed relative to each other, permitting the lugs to snap into engagement with the notches.

A plurality of each of the snap connecting lugs/notches 40/42 and 62/64 are employed in securing the compositively formed container 24 in assembled relation, four being a suitable number for each. The cooperating lug/notches may be equiangularly spaced.

The container components 32, 34 and 36 may, advantageously be formed of synesthetic, resinous materials of what are referred to as the "structural" type. That is, they are selected to provide the necessary strength, flexibility, resiliency, etc., for the functions herein ascribed. Many such synthetic resinous materials are available and their selection is within the capability of one skilled in the art. Delrin and fiber glass impregnated, polypropylene are referenced as possible structural synthetic resins capable of use for the stated purposes. The use of resinous materials is preferred for economic reasons. Not only are material costs relatively low, but the materials are readily adapted to molding in the illustrated configurations to minimize fabrication costs and minimize, if not eliminate, machining costs. The three piece, composite construction of the container 24 further minimizes its costs in taking advantage of the economies of utilizing resinous material components.

This composite construction is particularly useful in obtaining a relatively large capacity container. The background for the need of a large capacity container is that is desirable to prevent uncontrolled release of fuel where some malfunction requires release of the volume of fuel in a delivery hose. For example, if there is a failure to shut off the flow control valve in a timely fashion, fuel will back up in the delivery hose. In order to prevent ground contamination, it is necessary that the container 24 have a volume sufficient to receive this volume of fuel, something in the order of 35 gallons.

In order to obtain a container of such capacity, it has been found preferable to increase the intermediate diameter of the container, with a relatively small diameter for the upper end of the container. The overall height of the containment device is thus minimized.

The provision of a separate container body member 34, formed of resinous material and formed by a molding operation, is effective in minimizing the overall costs of the container.

Disposed within the container 24 is a riser pipe extension 73, which is threaded into a boss 75, which further defines the central opening through the container base 32. An adapter 77, of standard configuration, is threaded onto the upper end of the riser pipe extension 73. This provides means of connecting for effecting a connection with the riser pipe P, disposed wholly within the container 24.

Reference is next made to FIGS. 2 and 5–8 for a detailed description of the mounting for the container lid 26 and the locking means 30.

Figure 7:
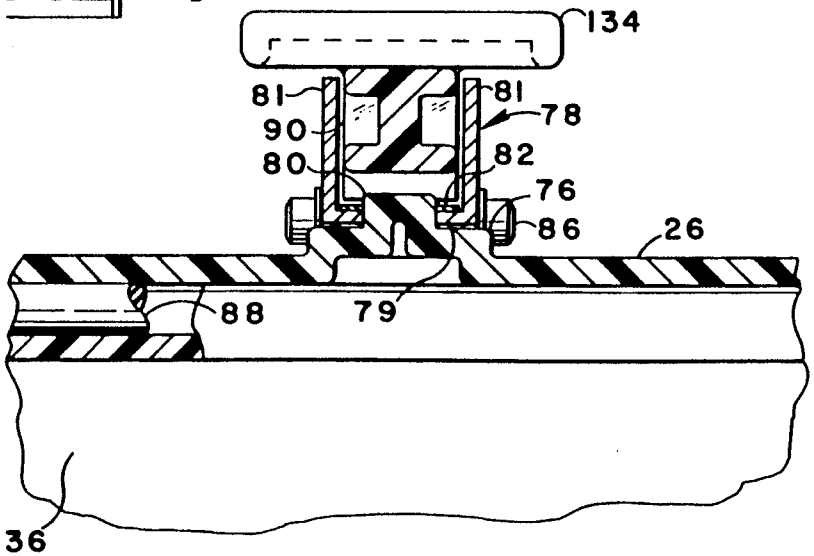
FIG. 7 is a section taken on line 7—7 in FIG. 5.

The lid 26 is in the form of a circular disc having a central boss 76, which spaces the lid beneath a mounting arm 78, FIGS. 2 and 7. The arm 78 has a U-shaped cross section formed by a bridge 79 and legs 81. An integral pin 80, projecting upwardly from the boss 76, is received in an opening in the bridge 81 of the U-shaped arm 78 and held in place by a friction push nut 82. The arm 78 is pivotally mounted on the container 24. More specifically, the legs 81 of the U-shaped arm 78 are extended to embrace a lug 84, which is molded integrally with the upper container member 36 and projects upwardly therefrom. A pin 86, passes through the legs 81 and the lug 84, to provide this pivotally mounting.

The arm 78 spans the central access opening of the upper container member 36 and is selectively locked relative thereto at its opposite end, by means now to be described. In this locked position, the lid is maintained is sealing engagement with an O-ring 88, which is positioned in a groove in the upper annular face of the upper member 36.

A lever 90, in its locking position, is disposed between the upstanding legs of the arm 78 and pivotally connected thereto by a pin 92. In the illustrated, locked position, the lever 90 underlies a pin 94 which extends between arms 96. The arms 96 are pivotally mounted on a pin 98, which extends through a boss 100, formed integrally with the upper container member 36. The pin 94 and arms 96 form a pivotally mounted bail, which is engaged by the lever 90 in locking the lid 26 in a closed position.

The relative disposition of the pivot centers for the arm 78, lever 90 and arms 96 provides an over the center relationship which assists in maintaining the lever 90 in this locking position.

Figure 13:
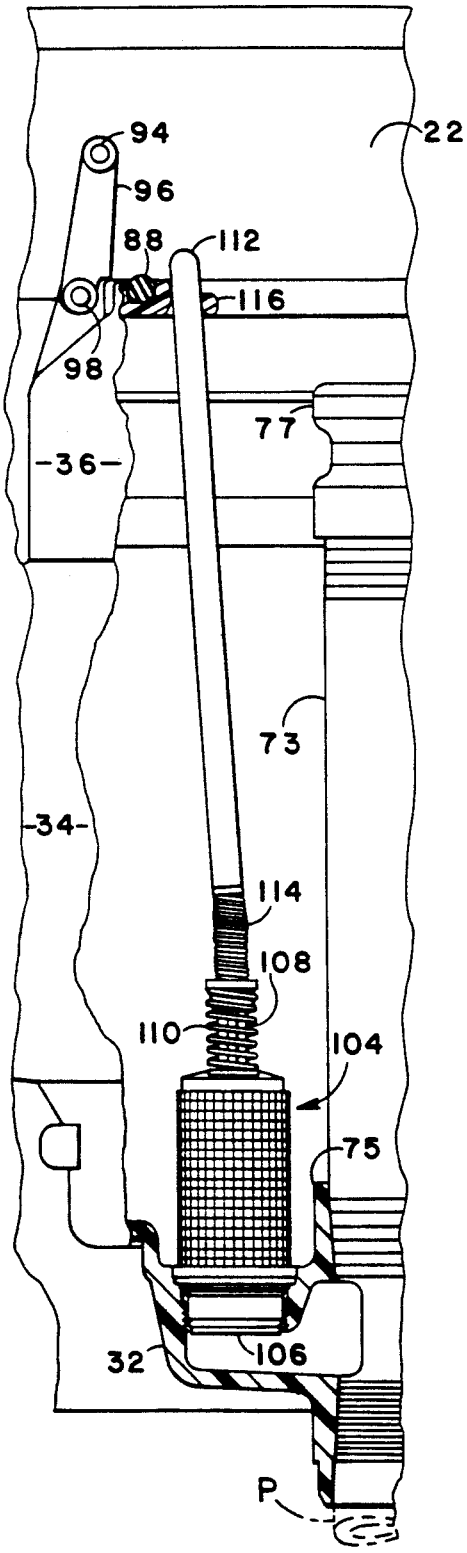
FIGS. 13 and 14 are views, partially in section, illustrating the interaction between the lid and a drainage valve.
Figure 14:
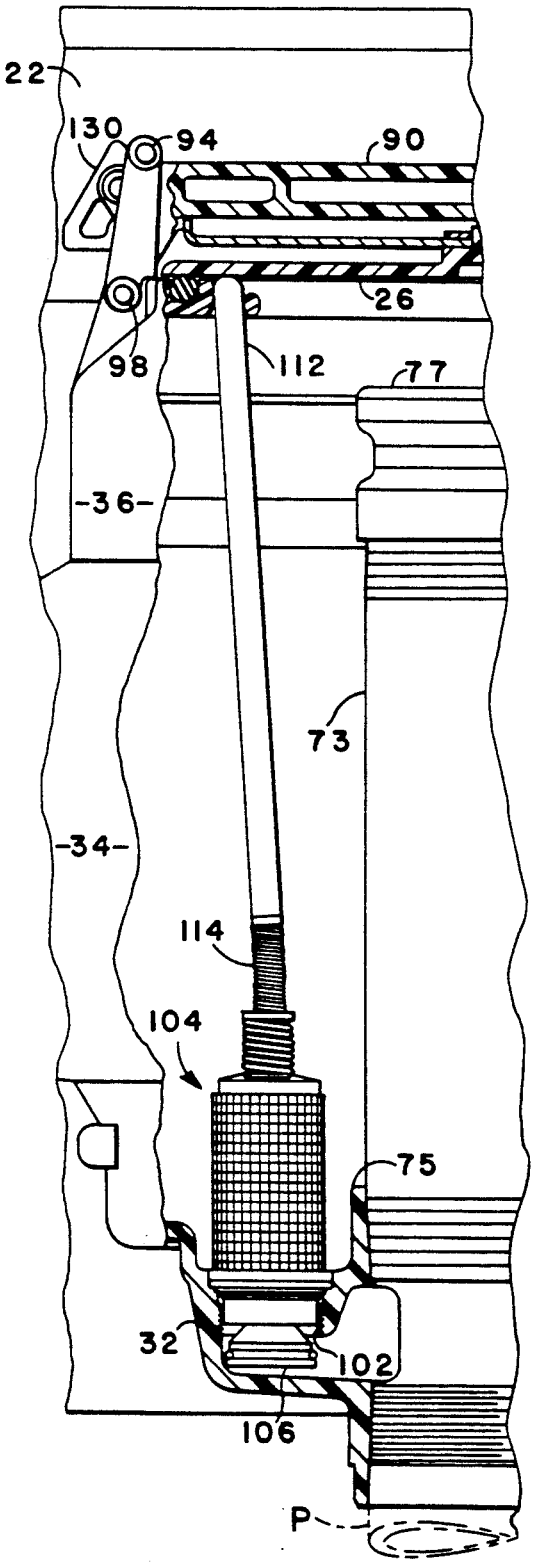

The containment device 20 also, preferably, includes a valve controlled drain connection between the container 24 and the riser pipe P, by way of an interval passageway 102, formed in the container base 32, FIGS. 13, 14. A valve 104 is mounted in the passageway 102 and controls flow therethrough. The bottom defining surface of the flange 50 is sloped downwardly (FIG. 2) toward the valve 104 and the valve 104 is mounted at the bottom of a counter bore 105, all to the end that, when the valve 104 is open, the container 24 will be completely drained.

The valve 104 may take various forms. The basic elements of the valve 104 are a poppet 106 which is responsive to movement of a stem 108 to be displaced from the lower open position, of FIG. 13 to the upper closed position of FIG. 14. A spring 110 urges to the stem 108 upwardly to resiliently maintain the poppet 106 in its closed position.

The valve stem 108 is connected to an actuating rod 112 by a coiled spring 114, which permits limited, angular movement of the rod 112 relative to the stem 108. The rod 112 extends upwardly being guided by an opening formed in lug 116, which projects inwardly from the opening defining, upper end of the upper container member 36, see also FIG. 3. In the closed position of the lid 26, FIG. 14, the upper end of the rod 112, is engaged by the under surface of the lid 26, to maintain the poppet 106 in its open position.

The manhole 22, preferably, has a reduced diameter, at its upper end, which is larger than the upper diameter of the container 24, and, when installed, is spaced therefrom. The manhole 22 is angled and flared outwardly from its upper, reduced diameter so as to be spaced from the increased diameter of the body member portion of the container 24. The manhole 22 also extends downwardly beneath the container 24 so that the container portion of the containment device is isolated from the peal grave or soil that is back filled in the installation process.

Installation and use of the present containment device will now be described.

In the installation process, the storage tank T is first disposed in an excavation, with the riser pipe P disposed as close as possible, to a vertical position. Accurate vertical alignment is difficult due to the mass of the storage tank.

The containment device 20 is next mounted on the upper end of the riser pipe P. Various options are available in so mounting the containment device. A preferred method is to first mount the assembled container 24 on the riser pipe. To facilitate this end, torquing lugs 118 are provided on the upper surface of the base member boss 75. With the riser pipe extension 73 removed, the base member may be readily threaded onto the upper end of the riser pipe P by a "T" wrench. After the base 34 is secured to the riser pipe, the extension 73 and adapter 77 are assembled, as illustrated.

The lid 26 and lid locking means may be assembled on the container 24 prior to the container being mounted on the riser pipe, or may be secured after the container is so mounted. The latter approach facilitates effecting a connection with the riser pipe. The single pin (86) mounting connection for the lid/locking lever assembly facilitates the latter approach. The locking pin 94 is relatively small and is, preferably, mounted on the container 24 at the time it is mounted on the riser pipe.

Alternatively, the riser pipe extension 73 may be threaded into the boss 75, at the time the container is mounted on the riser pipe. With the adapter 77 removed, a tubular wrench can be telescoped over the riser pipe extension 73 and provided with projections which are engageable with the lugs 118 to torque the base member 32 onto the riser pipe P.

Further aspects of the invention are found in its packaging for shipment to an installation site. When so shipped, the containment device is assembled, as illustrated in FIGS. 1 and 2.

Figure 4:
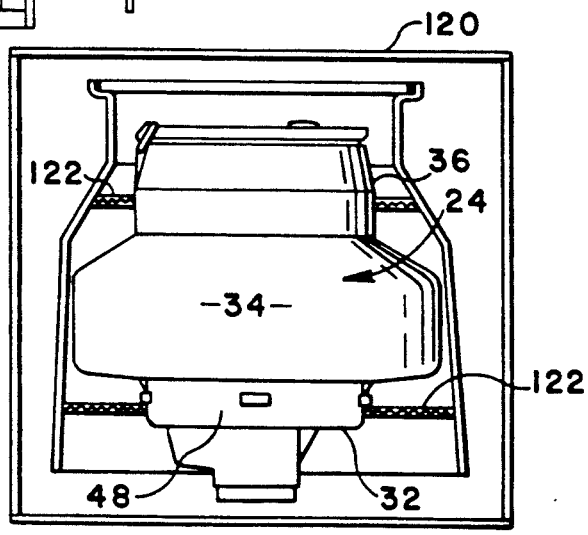
FIG. 4 is a simplified view of a containment device and manhole mounted in a shipping carton.

For the sake of economy, a containment device 2 and the manhole 22, with which it is to be used, are shipped in the same shipping carton, which is indicated by reference character 120 in FIG. 4. It will also be noted that the manhole 22 is concentrically positioned in spaced relation relative to the containment device 20 in the same relative relationship shown in the installed position of FIG. 1. This positioning is provided by corrugated paper spacers 122, 124 which are telescoped, respectively, over the upper member 36 and the base member 32, more specifically the tubular portion 48 of the body member 34. Further support and positioning means, not shown, position the manhole 22 and containment device 20, within the carton 120, to provide protection from damage during shipping and handling.

When the manhole 22 and containment device 20 are removed from the carton, the spacers 122, 124 are saved. After the containment device 20 is mounted on a riser pipe, the spacers 122, 124 are remounted on the container 24, in the relative position, as in the shipping carton. The manhole 22 is then positioned on the spacers 122, 124, and adjusted so that its upper end is disposed at a desired grade level and in a horizontal plane. As previously indicated, the mass of the storage tank makes difficult accurate positioning of the upper end of the riser pipe. This is true both as both an angular sense and a heightwise sense. If manhole 22 is not at desired height or angle, the spacer means are displaced, or deformed and deflected to achieve the proper relative position of the manhole.

The use of the spacers in this fashion enables the upper end of the manhole to be accurately positioned relative to a desired grade level, which, frequently must be a grade level common with that of other manholes for adjacent storage tanks, which are to be overlaid by a common apron. After the manhole is thus positioned, backfilling of the pea gravel layer is completed and the concrete apron poured. It is to be noted that the lower spacer limits intrusion of backfill through the lower end of the manhole. This prevents gravel, or other backfill material, from getting between the container 24 and the manhole 22. Thus, there is freedom for relative movement between the container and the manhole, as the result of frost heaves, or the like.

With further reference to the spacers 122, 124, the corrugated paper employed therefor, is not critical. The weight and construction of the corrugated paper, as commonly employed shipping cartons, can be readily selected to obtain the desired ends. The outlines of the spacers can be selected to obtain friction fits with the manhole and the containment device which are sufficient to maintain the manhole in a desired position during pouring of the concrete apron. Additional flexibility of adjustment is found in the fact that the corrugated paper can be bent to maintain the manhole in a desired position.

After installation, the spacers 122, 124 are left in place. The corrugated paper quickly degrades, so that there is no interference with drainage of ground water through the manhole.

While it is preferred to use corrugated paper sheets as the spacer means, it is to be recognized that alternate means and materials could be employed. By way of illustration, deformable resinous material, such as a foamed polystyrene, could be used. Since such material is not readily degradable, it would be necessary to provide drainage holes, which would permit ground water to pass therethrough for absorption into the underlying gravel and soil.

When it is desired to load fuel into the tank T, the manhole cover 28 is removed from a seat 123 formed integrally at the upper end of the manhole, to provide manual access to the lid locking mechanism 30.

Figure 5:
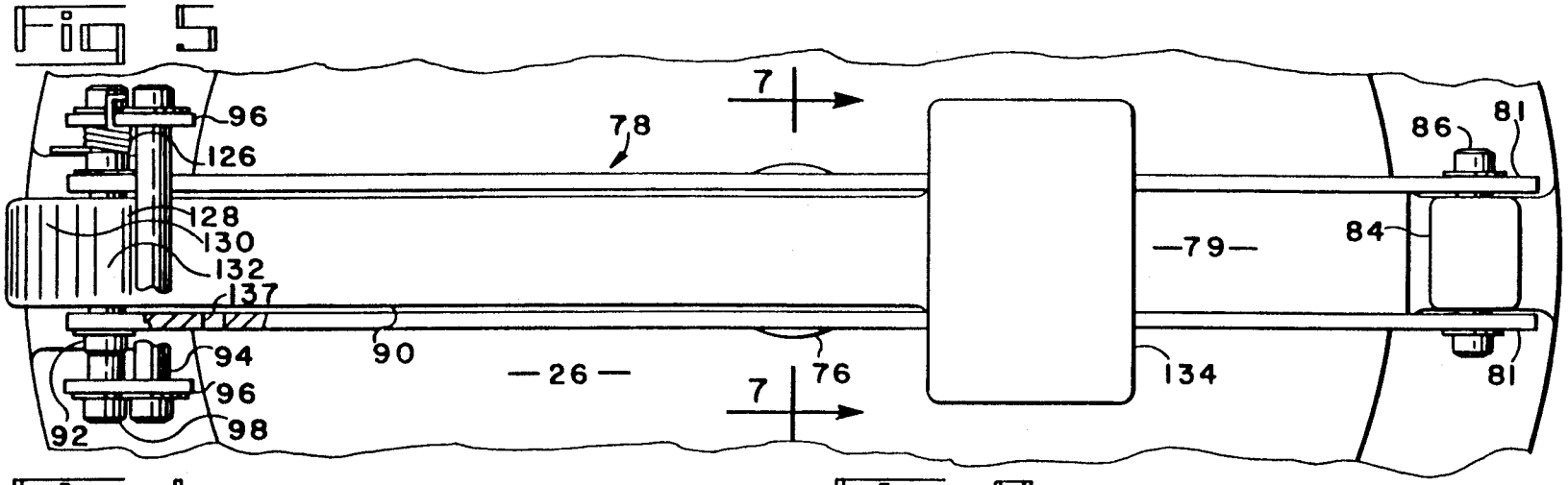
FIG. 5 is a fragmentary plan view, on a further enlarged scale, of lid locking means employed in the containment device.
Figure 6:
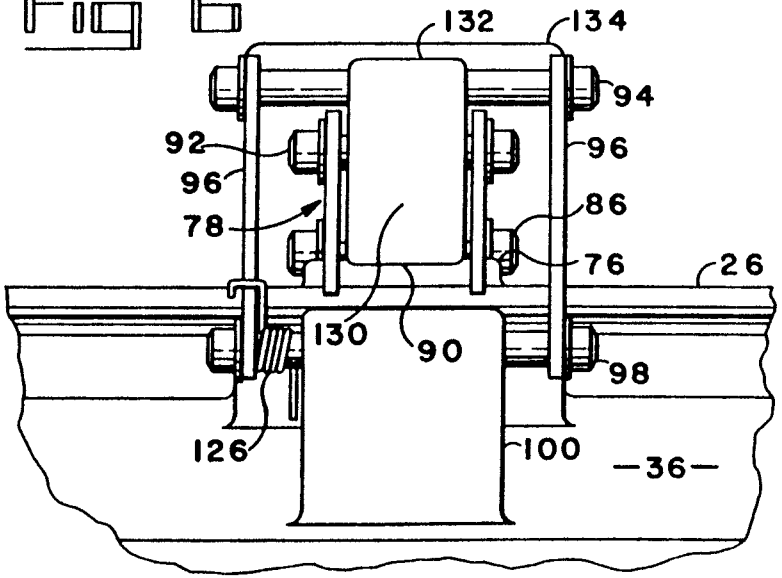
FIG. 6 is an end view, taken from the left end of FIG. 5.

At this point it will be noted that the locking pin 94 is yieldingly urged toward its locking position by a torsion spring 126, acting on one of the arms 96, see FIGS. 5, 6 and 8. Clockwise movement of the lever arms 96 to this locking position is limited by abutments 125 formed on thereon and engageable with a shoulder on the upper member 36, FIG. 8.

It will also be noted that the lever 90 has, above the pivot pin 92, camming surfaces 128, 130, on opposite sides of projection 132.

Further note is taken of the provision of a handle 134 at the free end of the lever 90, to facilitate manual gripping of the lever. The handle 134 also is engageable with the support arm legs 82 to limit clockwise movement of the lever 90.

Figure 10:
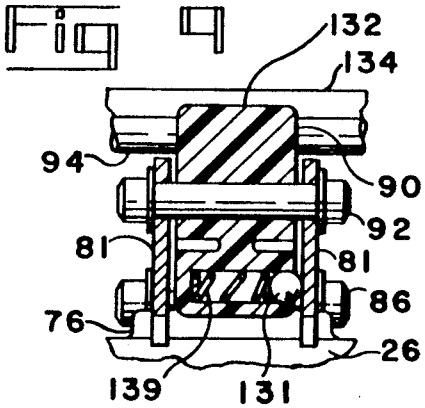

With the cover 28 removed, the handle 134 is gripped to swing the lever 90 to the vertical position illustrated in FIG. 11. The handle 134 may then pulled upwardly to pivot the support arm 78, about the pivot pin 86, to the generally vertical position illustrated in FIG. 10. Actually, in this position, the upper end of the support arm 78 is disposed somewhat outwardly of the axis of the pin 86 so that the lid will be maintained in its open position by gravity.

In swinging the lever 90 to the position of FIG. 11, the locking pin 94 is displaced in a counterclockwise direction. Then, when the support arm 78 is swung to the position of FIG. 10, the locking pin 94 is displaced further in a counterclockwise direction by the camming surface 128, to release the lever 90 from the locking pin 94.

With the lid 26 thus in its open position, a fuel hose may be readily coupled to the adapter 77 and the storage tank T filled with fuel in conventional fashion. The fuel hose is then disconnected and the lid returned to its closed position.

Closing and locking of the lid is done in reverse fashion to the opening steps above described. Thus the support arm 78 is swung downwardly toward to the position of FIG. 11. As the support arm approaches its horizontal position, the cam surface 130 displaces the locking pin 94 in a counterclockwise direction, until the projection 132 passes therebeneath. Spring 126 then returns the locking pin into engagement with the camming surface 128. When the lever 90 is swung back to the locking position of FIG. 2. In so swinging the lever, the camming surface 128 engages the locking pin 94 to provide a positive sealing force between the lid 26 and the sealing ring 88. After the lid is closed and locked, a pin, or the shackle of a lock can be inserted through aligned holes 127, 129, formed in the support arm legs 81 and the lever 90, respectively. Inadvertent, or unauthorized opening of the container 24 can thus be prevented.

Figure 9:
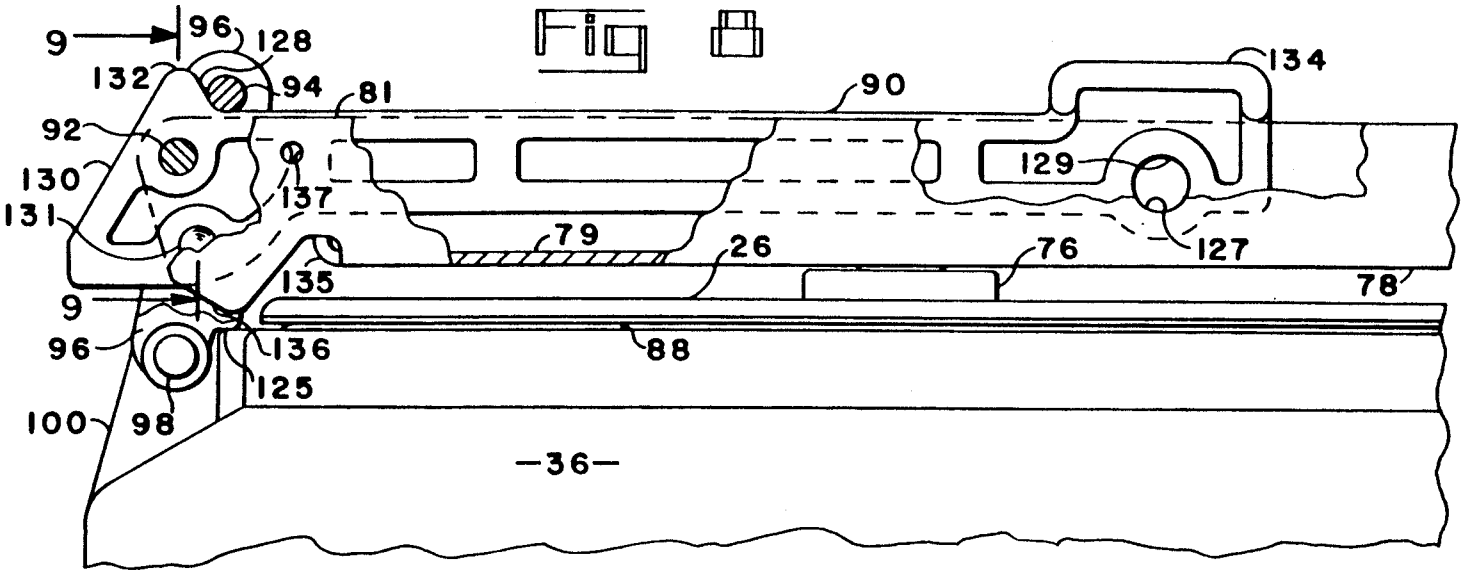
FIG. 9 is a section, taken on line 9—9 in FIG. 8.

It is preferred to provide detect means for maintaining the lever 90 in its release or unlocking position relative to the support arm 78. To this end, a detent ball 131 (FIGS. 8 and 9) is mounted in the lever 90, adjacent the pivot pin 92. In the locked position of the lever 90, a spring 133 urges the ball 131 against one of the support arm legs 81. When the lever 90 is swung to its release position (FIG. 11), a lower surface of the lever engages a curved end 135 of the support arm bridge 79. In this release position, the ball 131 is registered with and yieldably engages a hole 137.

The described detent means maintain the camming surface 130 in a position to displace the bail pin 94 outwardly, when the support arm 78 is swung to its closed position. Thus, there is an reasonable assurance that the lever 90 will engage and latch with the bail pin, when swung into nested relationship with the support arm 78.

The described locking means also provides means for alerting an attendant that the lid 26 is not properly sealed. Such situation could arise from the support arm being inadvertently displaced from the detent means prior to displacing the locking pin 124 in overlying relation with the lever. If this should occur, the lever 90 would remain above the locking pin 94, as shown in FIG. 12. If the attendant fails to appreciated that the lever 90 has not been properly locked, and puts the cover 28 in place, it will come to rest on the projection 132. The attendant will be alerted by the tilted cover 28, to properly engage the lever 90 to lock the lid 26.

Should the attendant not immediately notice the fact that the cover is tilted, means are provided to prevent damage to the containment device 20, in the event that a vehicle should run over the cover. To this end, camming surfaces 136 are formed on the outer extensions of the legs of the U-shaped support arm 78. In the position of FIG. 12, the camming surfaces engage the locking pin 94. Should the cover then be depressed, as by a vehicle running over it, the locking pin 94 will be cammed in a counterclockwise direction, without transmitting any forces which could damage the support arm 78, locking lever 90, or other component of the containment device.

It will be apparent that when the id 26 is unlocked and pivoted to its open position, the valve 104 is automatically closed. Normally it is to be expected, that there will be some spilling of fuel as a delivery hose is connected to and then disconnected from the adapter 77. After the delivery hose is disconnected, the interior of the container 24 is visually inspected. If there is nothing other than spilled fuel in the container, the lid 26 is closed and locked. When this is done, the valve 104 is automatically opened, as the rod 112 is depressed by the lid 26. Any spilled fuel drains to the storage tank through the passageway 102. If there is foreign matter in the container 24, it is removed, if possible, and then the lid 26 is closed and locked and any spilled fuel returned to the storage tank. If water is observed in the container, or if there is foreign matter that can't be removed, it becomes necessary to clean the container before closing the lid. In any event, when the lid 26 is in an open position, the valve 104 is closed to the end that foreign matter or water cannot flow into the storage tank, without there first being an opportunity to its removal to prevent contamination of the fuel in the storage tank.

It will also be noted that it is conventional practice to close off the upper end of a riser pipe, at all times other than when fuel is being discharged into a storage tank. A closure cap (not shown) suitable for such purposes may be secured to the adapter 77. Such cap would then be removed to permit connection of a fuel hose connector to the adapter and then replaced, after delivery of fuel, before closing of the lid 26.

Figure 15:
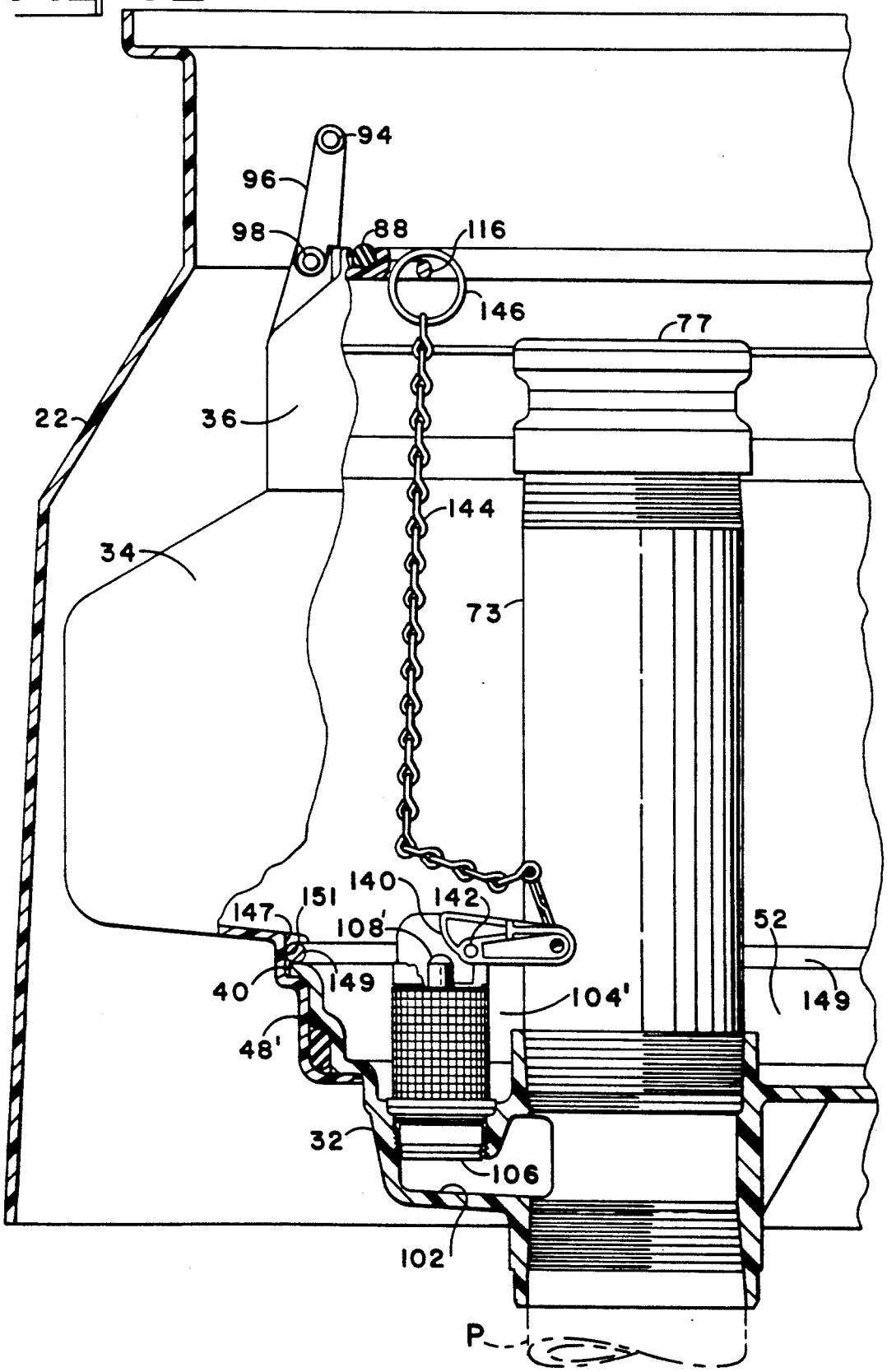
FIG. 15 is a view, partially in section, illustrating an alternate means for actuating the drain valve.

FIG. 15 illustrates an alternate embodiment of the invention, which differs in the construction of the container drain valve 104', and more particularly in the mode of its actuation.

The valve 104' again comprises a poppet 106, which controls fuel flow through a return passageway 102, formed in the base member 32. An internal spring (not shown) yieldingly maintains the poppet 106 in an upper, closed position. The poppet is connected, and responsive to movement of a plunger 108'.

An actuating, cam lever 140 is pivotally mounted on the housing structure of the valve 104', by a pin 142. The lever 140 projects laterally of the valve 104' (being angle from the riser pipe extension 73). A flexible line in the form of a chain 144 is connected to the outer end of the lever 140 and extends to the apertured lug 116, on the upper container member 36, being connected thereto by a ring 146.

The valve 104' provides the same functions as the valve 104 in controlling drainage from the container 24 to the storage tank T. It differs in that it is opened manually, rather than automatically. Thus, after filling of the storage tank, after visually ascertaining that there is no water or foreign matter in the container, the chain 144 is pulled upwardly, pivoting the lever 140 to engage the plunger 108' and depress the poppet 106 to its open position. After the container is drained, the chain 144 is released and the poppet 102 returns, automatically, to its closed position. It will be appreciated that tethering the end of the chain to the upper end of the container 24 facilitates manual actuation of the valve 104'.

FIG. 15 also illustrates an alternate means for connecting the body member 34 to the base member 32. In this embodiment, the base lugs 40 are received in vertical grooves 147 formed in the lower tubular portion 48'. The lugs 40 are held against the bottoms of the grooves 147 by a split retainer ring 149, which is seated in a circumferential groove 151. The retainer ring 149 is resilient, preferably formed of steel, and may be snap fitted into the groove 151.

This arrangement facilitates mounting of the container 24 on the riser pipe P in that the base member 32 may be separately threaded onto the riser pipe. When this is done, the pre-connected body member 34 and upper member 36 have been disposed over the riser pipe. After the base member has been secured, the body member, with the attached upper member, is raised to telescope the tubular portions 48, 52 to the position of FIG. 15. The retainer ring 149 is then snapped into the groove 151 to complete assembly of the container 24.

Figure 16:
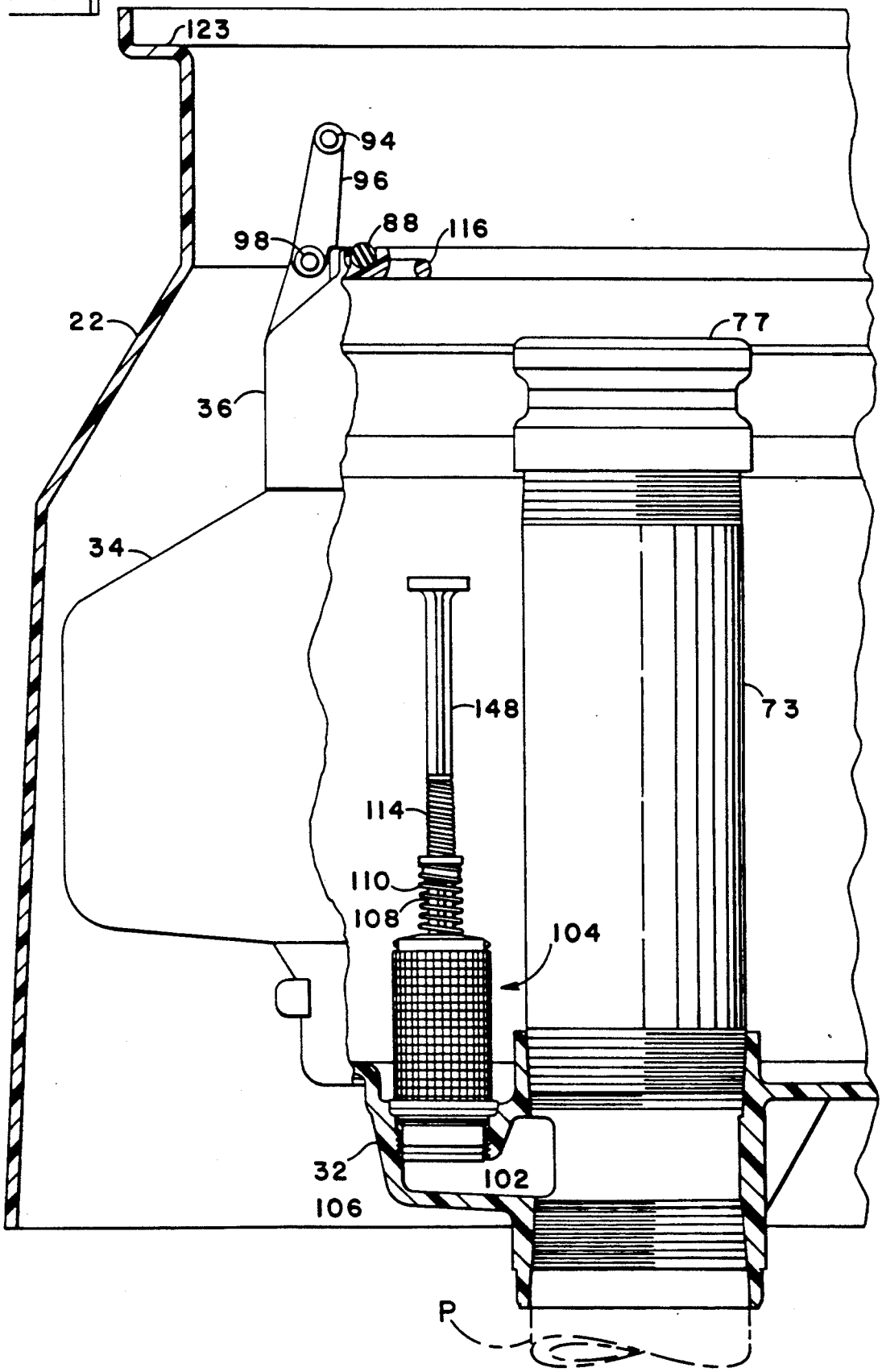
FIG. 16 is a view, partially in section, illustrating an other alternate means for actuating the drain valve.

FIG. 16 illustrates another alternate embodiment of the invention which, again, varies as to the manner of actuating the container drain valve. In this embodiment the valve 104 is also employed. However, a manual actuating rod 148 is substituted for the automatic actuating rod 112 of the first described embodiment. The manual actuating rod is connected to the valve plunger 108 by the coiled spring 114, to provide a flexible connection therebetween, to minimize the possible of accidental damage during use.

Operation of the valve 104, in this embodiment is essentially the same as in the embodiment of FIG. 12. That is, when it is desired to drain the container 24, the manually actuated rod 148 is simply depressed. When draining is complete, the rod 148 is released and the spring 110 is effective to return the poppet 106 to its closed position.

Figure 17:
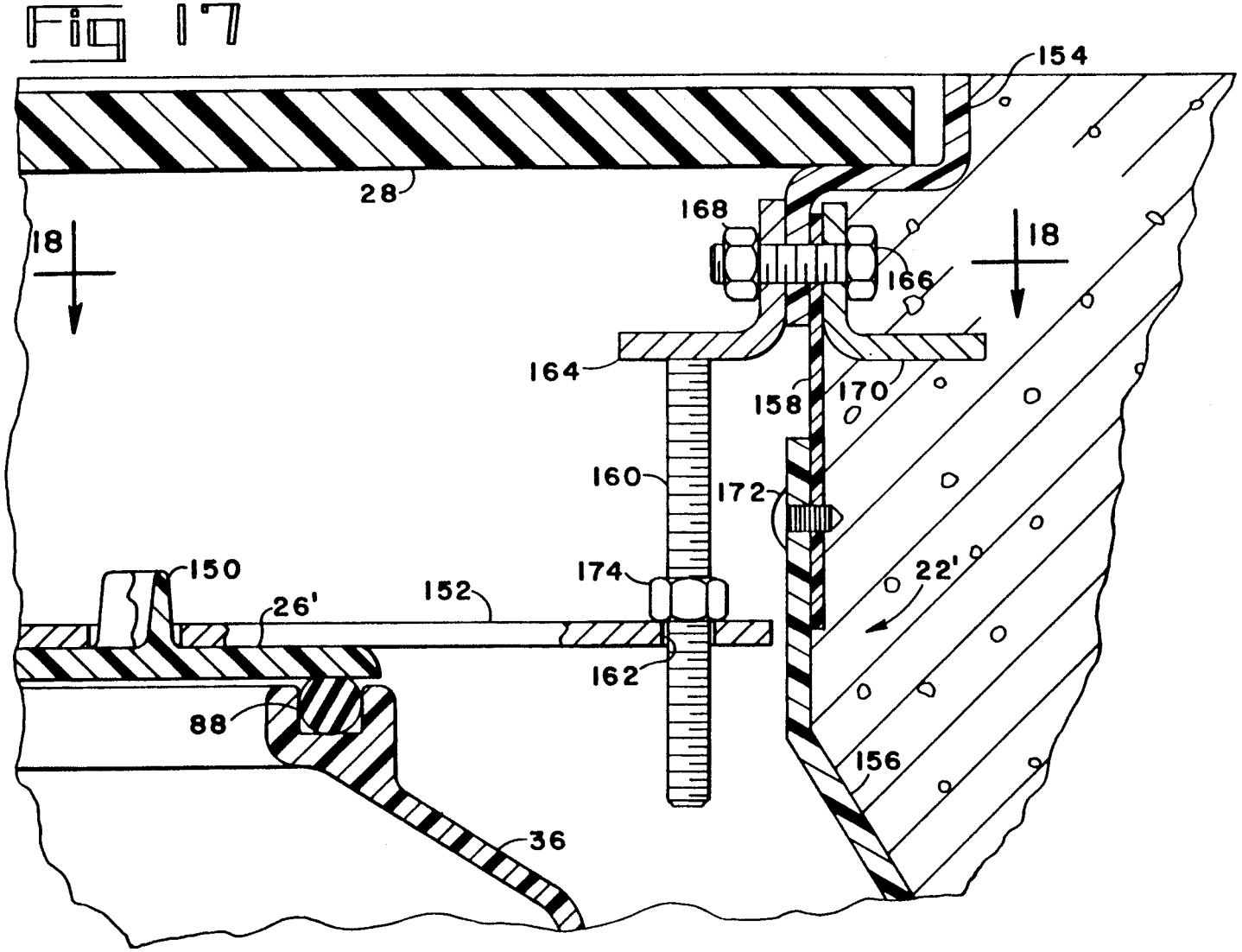
FIG. 17 is an elevation, in section, illustrating an alternate means for adjusting the relation between the containment device and the manhole during installation.
Figure 10:
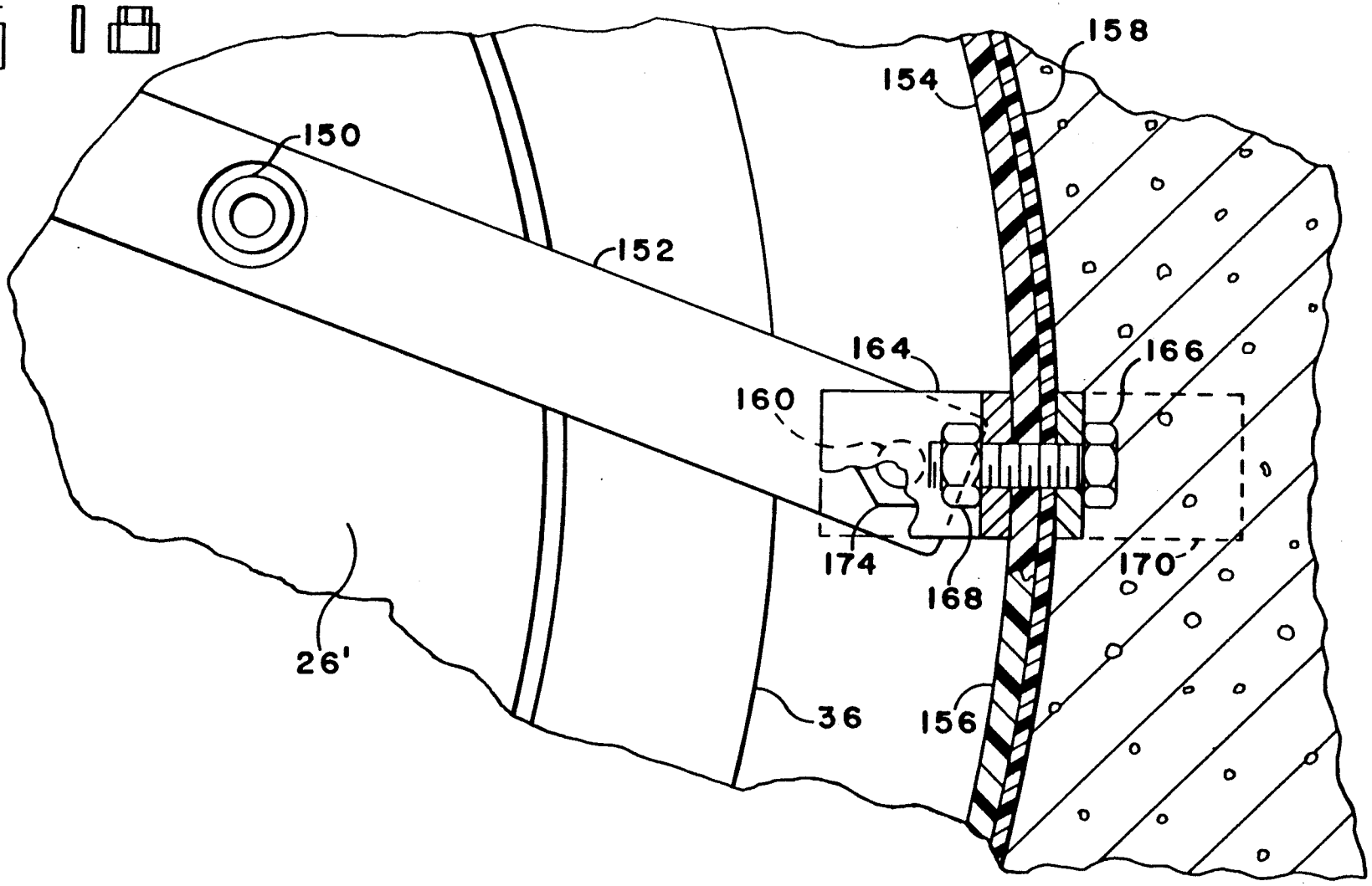

Reference is next made to FIGS. 17 and 18 for a description of alternate means for attaining a desired relation between the containment device 20 and a modified manhole 22' during installation. The manhole 22' provides the further advantage of avoiding damage thereto as the result of settling, or frost heaves.

The containment device 20 is modified to the extent that positioning studs 150 are provided on the upper surface of a lid 26'. Four studs 150 are provided, the details of which are the same as for the one stud illustrated and described. A bar 152 is supported on and positioned by one pair of studs 150. A second, identical bar (not shown) is supported on the other pair of studs 150.

The manhole 22' differs in that it is compositely formed by a rim, or seat portion 154, a lower, protective shell portion 156 and a tubular, intermediate member 158.

Adjustable support means for the manhole 22' are provided at each end of the bars 150, being roughly equiangularly spaced. These means comprise an adjusting screw 160, the lower end of which is loosely received in a hole 162. The screw 160 projects downwardly from and is secured to an angle bracket 164. The angle bracket 164 is secured to the manhole seat portion 154 by a bolt 166 and nut 168. The bolt 166 also passes through an angle bracket 170 and telescoped portions of the seat portion 154 and the intermediate member 158, holding the latter in fixed, assembled relation. The intermediate portion 158 is telescoped over the lower, shell portion 156 by frangible means comprising angularly spaced fasteners 172 (only one of which is illustrated). The fasteners 172 may be of the so-called, plastic, push type, "plastic" denoting a suitably synthetic resin. Such fasteners are simply pushed through aligned holes in the intermediate member 158 and the shell portion 156 and frictionally held in place.

Reverting back to the adjusting screw 160, a nut 174 is threaded thereon and overlies and engages the bar 152. It will be apparent that the shell 22' simply rests on and is supported by the respective ends of the bars 152, which, in turn rest on and are supported by the lid 26'.

When an installation is to be made, the containment device 20 is mounted or a riser pipe, as above described. This can be done with, or without the manhole mounted thereon. Preferably, the manhole 22' would be removed from the containment device, at the time the containment device is so mounted. After the containment device is attached to the riser pipe, the bars 152 can be readily positioned on the studs 150 and then the manhole 22' positioned with the adjusting screws inserted through the holes 162. The manhole is then supported, by engagement of the nuts 174, with the bars 152.

After the manhole 22' is so positioned, the nuts may be rotated to bring the seat portion 154 to a desired grade level and/or selectively rotated to bring the seal portion 154 to a horizontal plane. Once the manhole 22' is in the proper position, backfilling is completed and the concrete apron A is poured, as before. The angle brackets 170 serve as anchors to prevent relative movement between the seat portion 154 and the concrete apron.

After the concrete apron is poured, the nuts 168 may be removed and then the nuts 174 threaded upwardly. This permits each of the brackets 164 and attached screws 160 to be removed. After they are removed, the bars 152 may be simply lifted off of the lid 26' and the containment device is ready for use in the fashion previously described. To complete the installation, the nuts 168 may be reattached to the bolts 166.

The composite construction of the manhole 22' is adapted to prevent it from being damaged as a result of frost heaves or settling of the soil underlying the apron. The composite construction would also prevent possible damage to the apron, as a result of such conditions. This is to point out that the rim portion is positively locked relative to the concrete apron, so that, in no event, will the rim project any substantial distance above the apron. On the other hand, the lower end of the manhole, specifically the shell portion 156 is, to a greater or lesser extent, locked into the underling gravel layer and/or backfilled soil. Thus, due to settling, or frost heaves, there can be forces which tend to vertically displace the lower end of the manhole (sell 156) relative to the upper end of the manhole (seat portion 154). The fasteners 172 are designed to fail, or break, in response to such forces, before reach a magnitude sufficient to cause a failure of the connection between the seat portion 154, or a magnitude which displace the shell portion 156 to a position in which it is no longer spaced from the containment device, or a magnitude which is otherwise suffice to damage the components of the manhole.

Characterized in other words, the manhole has a releasable, telescopable connection between the upper seat portion and the lower shell portion.

One further point to note in connection with the manhole 22' is that the distance from the upper end of the seat portion 154 to the telescoped, conical portion of the shell portion 156 is greater than the thickness of the concrete apron. This permits the apron to shift downwardly carrying with it the seat portion 154, upon breaking of the frangible fasteners 172. This is to say that the concrete is not locked to this telescoped tubular portion and can be shifted downwardly, without damaging or displacing the lower shell portion 156.

This releasable connection could also be provided by an interference, or friction fit, between the telescoped portions of the rim portion and the shell portion. Such a friction fit can be designed to permit the manhole to be handled as a unit during the installation process. Likewise, the friction fit can be designed so that there can be relative movement, as a result of settling, or the like, in response to a force insufficient to damage the connection between the rim portion and the apron, or otherwise damage the manhole, or cause it to be too closely spaced from the containment device.

Various modifications of the primary embodiment, including those described, will occur to those skilled in the art, within the spirit and scope of the present inventive concepts, which are set forth in the following claims.

Having thus described the invention, what is claimed as novel and desired to be secured by Letters Patent of the U.S. is:

1. A spill containment device adapted for mounting on the upper end the riser pipe of an underground storage tank for liquid fuel, or other hazardous liquids, said device comprising a container adapted for rigid, sealed connection with a riser pipe, and having an upper access opening, and lid means for sealingly closing the upper access opening, said container being characterized in that it is compositely formed and comprises a base member having means for rigidly connecting it with the riser pipe, a shell like body member rigidly and sealingly joined to the base member, and an upper member rigidly and sealingly joined to the body member and defining the upper access opening of the container.

2. A spill containment device as in claim 1, wherein the compositely formed container is further characterized in that the base member has a central opening having threads, in its lower end, for providing a connection with the riser pipe. and further including a riser pipe extension mounted in the upper end of the central opening of the base member, the upper end of the riser pipe extension being wholly disposed within the container and adapted for connection with a fuel delivery hose.

3. A spill containment device as in claim 2, wherein the said base member is further characterized by torquing means for threading the base member onto the riser pipe.

4. A spill containment device as in claim 3, wherein the said base member is further characterized by an upstanding boss defining said central opening, and the torquing means comprise upwardly open lug means for receipt of a wrench to be employed in threading the base member onto the riser pipe.

5. A spill containment device as in claim 1, wherein the compositely formed container is further characterized in that the body member has a lower tubular portion and the base member has tubular portion in telescoped relation therewith, means for maintaining said tubular portions in telescoped, assembled relation, and the body member has an upper tubular portion and the upper member has a tubular portion in telescoped relation therewith, and means for maintaining said the tubular portions of the body member and the upper member is telescoped, assembled relation.

6. A spill containment device as in claim 5, wherein the compositely formed container is further characterized in that the base member, body member and upper member are formed of structural, synthetic resinous materials, and the means for maintaining the tubular portions of the body member and the upper member in assembled relation, comprise cooperating, snap fitted lug and notch means.

7. A spill containment device as in claim 6, wherein the compositely formed container is further characterized by O-ring means disposed, respectively, between the base member and the body member and between the body member and the upper member, to provide seals therebetween.

8. A spill containment device as in claim 6, wherein the compositely formed container is further characterized in that the base member comprises a generally radial, bottom forming flange from which the tubular portion projects upwardly, the portion of the body member, intermediate the tubular portions, has a substantially greater vertical outline than the outlines of the tubular portions of the base and upper members, the tubular portion of the base member is telescoped within the lower tubular portion of the body member, the lower end of the lower tubular flange, of the body member, has an inturned flange, which underlies the bottom forming flange of the base member.

9. A spill containment device as in claim 8, wherein the compositely formed container is further characterized in that the means for maintaining the tubular portions of the base member and the body member comprise a plurality of angularly spaced, outwardly projecting lugs on the base member, tubular portion and a plurality of inwardly facing notches formed in the inner surface of the lower, body member, tubular portion, and camming means for displacing the telescoped portions during assembly to provide a snap fit engagement of the lugs with the notches.

10. A spill containment device as in claim 9, wherein the compositely formed container is further characterized in that said camming means comprise angled surfaces formed on the body member above said notches.

11. A spill containment device as in claim 8, wherein the compositely formed container is further characterized by an O-ring disposed between the base member and lower flange of the body member at the juncture of the base member flange and the base member tubular portion, to provide a seal with the body member.

12. A spill containment device as in claim 6, wherein the compositely formed container is further characterized in that the upper end of the upper member forms a seat for said lid, the portion of the body member, intermediate the tubular portions, has a substantially greater vertical outline than the outlines of the tubular portions of the base and upper members, and the tubular portion of the upper member is telescoped over the upper tubular portion of the body member.

13. A spill containment device as in claim 12, wherein the compositely formed container is further characterized in that the lug and notch means for the upper, body member, tubular portion and the base member, tubular portion comprise a plurality of angularly spaced, inwardly projecting lugs on the upper, body member, tubular portion and a plurality of outwardly facing notches formed in the outer surface of the upper member, tubular portion, and camming means for displacing the telescoped portions during assembly to provide a snap fit engagement of the lugs with the notches.

14. A spill containment device as in claim 13, wherein the compositely formed container is further characterized in that said camming means comprise angled surfaces formed on the upper, body member, tubular portion, extending downwardly from the upper end thereof.

15. A spill containment device as in claim 13, wherein the compositely formed container is further characterized by an O-ring disposed between the upper member, tubular portion and the upper flange of the body member, to provide a seal the body member and the upper member.

16. A spill containment device as in claim 1, further comprising means for pivotal mounting the lid, and means for locking the lid in a closed position, and the compositely formed container is further characterized in that the upper member is formed of a structural, synthetic resin material, and includes a first integral lug disposed to one side thereof and providing a support for the pivotal mounting means, and a second integral lug at the opposite side thereof, on which a portion of the locking means is mounted.

17. A spill containment device as in claim 16, further characterized in that the mounting means for the lid comprises an arm pivotally mounted on said first, upper member lug, and means providing a connection between the lid and the arm, centrally of the lid, and the locking means comprise a locking lever pivotally mounted on said arm, adjacent the second integral lug of the upper member, and latch means mounted on said second integral lug.

18. A spill containment device as in claim 17, further characterized in that the latch means comprise a bail, pivotally mounted on the second integral lug of the upper member, and the lever has a portion which underlies the bail in the locked position of the lid.

19. A spill containment device as in claim 18, further characterized in that said bail is pivotally mounted and yieldingly urged into a position overlying said lever, and said lever includes first and second camming surfaces, said lever being pivotal, relative to said arm, to a release position, in which the bail is cammed out of engagement with the lever, as the arm is swung to bring the lid to an open position providing access to the interior of the container, said second camming surface displacing the bail to a position permitting the lever to underlie the bail, when the arm is swung to a closed position, with the lever in the release position.

20. A spill containment device as in claim 19 further characterized by detent means for releasably maintaining said lever in its release position.

21. A spill containment device as in claim 20 further characterized in that the support arm has a U-shaped cross section comprising a bridge and upstanding legs, said support arm legs having extensions providing the pivotal mounting of one end of the support arm on the first integral lug, and and leg extensions, to the opposite end of the arm, providing the pivotal mounting of the lever on the arm, and the detent means comprise a ball, mounted in the lever and yieldingly urged toward one of the leg extensions, which provides the pivotal mounting for the lever, and a detent formed in said one leg extension and engageable by said ball in the release position of the lever.

22. A spill containment device as in claim 21 further characterized in that
the web of the support arm forms an abutment surface engaged by the lever and limiting pivotal movement of said lever to its release position.

23. A spill containment device adapted for mounting on the upper end the riser pipe of an underground storage tank for liquid fuel, or other hazardous liquids, said device comprising
a container adapted for rigid, sealed connection with a riser pipe, and having an upper access opening,
lid means for sealingly closing the upper access opening,
mounting means for the lid comprising
an arm pivotally mounted on one side of the access opening, and
means providing a connection between the lid and the arm, centrally of the lid, and
means for locking the lid in its closed position, comprising
a locking lever pivotally mounted on said arm, adjacent on the other side of the access opening, and
latch means mounted on the container on the opposite side of said access opening.

24. A spill containment device as in claim 23, further characterized in that
the latch means comprise a pivotally mounted bail, and
the lever has a portion which underlies the bail in the locked position of the lid.

25. A spill containment device as in claim 24, further characterized in that
said bail is yieldingly urged into a position overlying said lever, said
said lever includes first and second camming surfaces,
said lever being pivotal, relative to said arm, to a release position, in which the bail is cammed out of engagement with the lever, as the arm is swung to bring the lid to an open position providing access to the interior of the container,
said second camming surface displacing the bail to a position permitting the lever to underlie the bail, when the arm is swung to a closed position, with the lever in the release position.

26. A spill containment device as in claim 25 further characterized by
detent means for releasably maintaining said layer in its release position.

27. A spill containment device as in claim 26 further characterized in that
the support arm has a U-shaped cross section comprising a bridge and upstanding legs,
said support arm legs having extensions providing the pivotal mounting of one end of the support arm on the first integral lug, and
and leg extensions, at the opposite end of the arm, providing the pivotal mounting of the lever on the arm, and
the detent means comprise
a ball, mounted in the lever and yieldingly urged toward one of the leg extensions, which provides the pivotal mounting for the lever, and
a detent formed in said one leg extension and engageable by said ball in the release position of the lever.

28. A spill containment device as in claim 19, in combination with a manhole, which comprises
a tubular portion within which the upper container member is disposed, with the upper end of the container spaced beneath the upper end of manhole, and
a removable cover overlying the upper end of the manhole,
said manhole having a seat for said cover to position it flush with the upper end of the manhole,
said spill containment device being further characterized in that
when the lid arm is swung toward a closed position and the lever is not engaged with the bail, means are disposed in obstructing relation with the manhole cover to maintain it in a tilted position, when placed over the manhole seat.

29. A combination as in claim 28, further characterized in that
said obstructing means comprise
a projection formed on said lever and
the first and second camming surfaces are disposed on opposite sides of the said projection.

30. A combination as in claim 28, further characterized in that
the obstructing means comprise means engaging said bail and preventing the arm to swing the lid to its closed position.

31. A combination as in claim 30, further characterized in that
the obstructing means include camming means, which displace the bail to a position preventing damaging forces to be transmitted therethrough, int he event the cover is forcibly depressed from its tilted position.

32. A below grade containment device installation wherein a manhole is disposed at a surface grade level, and a containment device is disposed within the upper end of the manhole and below said grade level,
said containment device being mounted on a riser pipe of an underground storage tank and comprising
a container having an access opening at its upper end,
lid means, for closing said access opening,
means for mounting said lid on said container and displacing said lid means between an open and a closed position,
said manhole having a seat at its upper end, and
a cover removably received in said manhole seat in a horizontal position flush with said grade level,
said containment device being characterized by
means for tilting the manhole cover relative to said seat, in the event said lid means are not fully closed.

33. A below grade installation as in claim 32, further characterized in that
the tilting means are yieldable and to prevent damage to prevent damage to the containment device, in the event the cover is depressed from its tilted position, as by a vehicle riding over the cover.

34. A below grade installation as in claim 32, further characterized in that
the means for mounting the lid means comprise
an arm, pivotally mounted on said container, and further characterized by
means, engageable with latching means mounted on said container, for locking said arm in a position in which the lid is in its closed position, and
the tilting means is responsive to a failure of the locking means to be engaged.

35. An below grade installation as in claim 32, further characterized in that
the mounting means for the lid comprises an arm pivotally mounted on one side of said container, and further comprising locking means, including latching means on the opposite side of said container, and a locking lever pivotally mounted on said arm, adjacent the latching means, said locking member being pivotal to engage said latch means to lock the lid in its closed position, and the tilting means comprise means disposed in obstructing relation with the manhole cover to maintain it in its tilted position, when the cover is placed on the manhole seat, and when the lid arm is swung toward a closed position and the lever is not engaged with the latch means.

36. A spill containment device as in claim 35, further characterized in that the latch means comprise a bail and the lever has a portion which underlies the bail in the locked position of the lid, and the bail comprises a portion of the obstructing means.

37. A spill containment device as in claim 36, further characterized in that said bail is pivotally mounted and yieldingly urged into a position overlying said lever, and said lever includes first and second camming surfaces, said lever being pivotal, relative to said arm, to a release position, in which the bail is cammed out of engagement with the lever, as the arm is swung to bring the lid to an open position providing access to the interior of the container, said second camming surface displacing the bail to a position permitting the lever to underlie the bail, when the arm is swung to a closed position, with the lever in the release position, and said obstructing means includes a projection formed on said lever and the first and second camming surfaces are disposed on opposite sides of the said projection.

38. A combination as in claim 37, further characterized in that the obstructing means include camming means, which displace the bail to a position preventing damaging forces to be transmitted therethrough, in the event the cover is forcibly depressed from its tilted position.

39. A spill containment device as in claim 1, further characterized in that the base member includes passageway means leading from the interior of the container to the riser pipe, and valve means for controlling flow of fuel through said passageway means.

40. A spill containment device as in claim 39, further characterized in that the lid means are displaceable between an open position and a closed, sealed position, and means responsive to the lid means being in a closed position for automatically opening said valve means, and responsive to the lid means being in an open position, for automatically closing said valve.

41. A spill containment device as in claim 40, further characterized by spring means urging the valve to a closed position to provide the means for automatically closing the valve, and by means engaged by the lid means, in the closed position of the lid means, for automatically opening said valve.

42. A spill containment device as in claim 41, wherein the valve includes a poppet and a plunger controlling movement of the poppet, and further characterized in that the means engaged by the lid means includes a rod, connected, at its lower end to said plunger, with its upper end positioned above the upper container member, when the lid is in its open position.

43. A spill containment device as in claim 42, further characterized by means, projecting inwardly of the container access opening, for guiding the upper end of said rod, and flexible means for connecting the lower end of the rod to the valve plunger.

44. A spill containment device as in claim 39, further characterized in that said valve is a normally closed, and further characterized by manual means for selectively opening said valve, said means including a flexible line tethered at its upper end to the container adjacent the access opening therefor.

45. A spill containment device as in claim 44, wherein the valve includes a poppet, yieldingly urged to a closed position, and a plunger for controlling movement of said poppet, and further characterized in that the means for opening the valve include a lever, mounted on said valve, having one end engageable with said plunger, and said flexible line is connected to the other end of said lever.

46. A spill containment device adapted for mounting on the upper end the riser pipe of an underground storage tank for liquid fuel, or other hazardous liquids, said device comprising a container adapted for rigid, sealed connection with a riser pipe, and having an upper access opening, and lid means for sealingly closing the upper access opening, said lid means being displaceable between an open position and a closed, sealed position, said container including passageway means leading from the interior of the container to the riser pipe, and valve means for controlling flow of fuel through said passageway means, said containment device being characterized by means responsive to the lid means being in a closed position for automatically opening said valve means, and responsive to the lid means being in an open position, for automatically closing said valve.

47. A spill containment device as in claim 46, further characterized by spring means urging the valve to a closed position to provide the means for automatically closing the valve, and by means engaged by the lid means, in the closed position of the lid means, for automatically opening said valve.

48. A spill containment device as in claim 47, wherein the valve includes a poppet and a plunger controlling movement of the poppet, and further characterized in that
the means engaged by the lid means includes
a rod, connected, at its lower end to said plunger, with its upper end positioned above the upper container member, when the lid is in its open position.

49. A spill containment device as in claim 48, further characterized by
means, projecting inwardly of the container access opening, for guiding the upper end of said rod, and flexible means for connecting the lower end of the rod of the valve plunger.

50. A spill containment device adapted for mounting on the upper end the riser pipe of an underground storage tank for liquid fuel, or other hazardous liquids, said device comprising
a container adapted for rigid, sealed connection with a riser pipe, and having an upper access opening, and
lid means for sealingly closing the upper access opening,
said lid means being displaceable between an open position and a closed, sealed position,
said container comprising passageway means leading from the interior of the container to the riser pipe, and
normally closed, valve means for controlling flow of fuel through said passageway means,
said containment device being characterized by
manual means for selectively opening said valve, said means including
a flexible line tethered at its upper end to the container adjacent the access opening therefor.

51. A spill containment device as in claim 50, wherein
the valve includes a poppet, yieldingly urged to a closed position, and
a plunger for controlling movement of said poppet, and
further characterized in that
the means for opening the valve include
a lever, mounted on said valve, having one end engageable with said plunger, and
said flexible line is connected to the other end of said lever.

52. A combination of a spill containment device, a manhole and adjustable means for obtaining a desired relationship therebetween in the installation thereof.
said means for obtaining a desired relationship being employed to bring the manhole to a desired heightwise and desired angular position, relative to the containment device, after the containment device has been mounted on the riser pipe of an underground storage tank,
said means for obtaining a desired relationship comprising
means mounted on said containment device,
means mounted on said manhole, and
a plurality of angularly spaced, independently adjustable means for adjusting the heightwise relation between the containment device mounted means and the manhole mounted means.

53. A combination as in claim 52, wherein
the containment device mounted means rests on and is supported by containment device, and
the manhole mounted means are attached to the manhole, and
the independently adjustable means each include threaded means.

54. A combination as in claim 53 wherein
the manhole mounted means are freely removable from the containment device mounted means and
the containment device mounted means are freely removable from the containment device.

55. A combination as in claim 54 wherein
the containment device mounted means comprise
a pair of bars,
and the independently adjustable means are effective between the respective ends of each bar and the manhole mounted means.

56. A combination as in claim 55 wherein
the containment device has a lid defining the upper end portion thereof,
the lid has studs projecting upwardly from its upper surface,
the bars are removably positioned by said studs.

57. A combination as in claim 55 wherein
each of the independently adjustable means include an adjusting screw and a nut.

58. A combination as in claim 56 wherein
holes are formed in each end portion of each bar,
angularly spaced, angle brackets are secured to the inner surface of the manhole,
an adjusting screw projects downward from each screw and passes freely through one of the bar holes, and
a nut is adjustably threaded onto each adjusting screw and engages the upper surface of the underlying bar, to support the manhole thereon.

59. A combination as in claim 58 wherein
each angle bracket is secured to the manhole by a bolt, which passes through the manhole, and a nut threaded thereon and acting against the angle bracket, and
the nut and bolts, which secure the angle brackets, also clamp concrete anchors against the outer surface of the manhole.

60. A combination as in claim 52, wherein
the manhole is compositely formed by
an upper rim portion and
a lower shell portion.
having vertically telescoped portions,
said manhole mounted means bind secured to said rim portion, and
means for preventing relative movement between said telescope portions until a threshold vertical force is exerted thereon,
whereby the rim and shell portions may be positioned, as a unit on the containment device, a concrete apron poured and the rim portion locked relative thereto, and then, after removal of the means for obtaining a desired relationship, the rim portion can shift relative to the shell portion as a result of settling, or the like.

61. A combination as in claim 60 wherein
the means preventing relative movement comprise
frangible fasteners extending through said telescoped portions.

62. A combination as in claim 61 wherein
the frangible fasteners are synthetic resin fasteners of the push type.

63. A manhole for use in combination with a spill containment device, said manhole comprising
an upper rim portion and
a lower shell portion.
having vertically telescoped portions, and means for preventing relative movement between said telescoped portions until a threshold vertical force is exerted thereon, whereby said manhole can be installed with the rim portion installed in locked relation to a concrete apron, and the shell portion, disposed beneath the apron can move relative thereto as a result of settling, or the like.

64. A combination as in claim 63 wherein the means preventing relative movement comprise frangible fasteners extending through said telescoped portions.

65. A combination as in claim 64 wherein the frangible fasteners are synthetic resin fasteners of the push type.

* * * * *